US007794587B2

(12) United States Patent
Varadaraj et al.

(10) Patent No.: US 7,794,587 B2
(45) Date of Patent: Sep. 14, 2010

(54) METHOD TO ALTER COKE MORPHOLOGY USING METAL SALTS OF AROMATIC SULFONIC ACIDS AND/OR POLYSULFONIC ACIDS

(75) Inventors: Ramesh Varadaraj, Flemington, NJ (US); Michael Siskin, Randolph, NJ (US); Leo D. Brown, Baton Rouge, LA (US); Cornelius H. Brons, Easton, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 211 days.

(21) Appl. No.: 12/010,145

(22) Filed: Jan. 22, 2008

(65) Prior Publication Data

US 2009/0184029 A1 Jul. 23, 2009

(51) Int. Cl.
*C10G 9/14* (2006.01)
*C10G 9/12* (2006.01)

(52) U.S. Cl. ..... 208/131; 208/48 R; 208/50

(58) Field of Classification Search ..... 208/131
See application file for complete search history.

(56) References Cited

U.S. PATENT DOCUMENTS

| | | | |
|---|---|---|---|
| 3,558,474 | A | 1/1971 | Gleim et al. |
| 3,617,514 | A | 11/1971 | Marlar |
| 3,684,697 | A | 8/1972 | Gamson |
| 3,707,459 | A | 12/1972 | Mason et al. |
| 3,769,200 | A | 10/1973 | Folkins |
| 3,852,047 | A | 12/1974 | Schlinger et al. |
| 4,140,623 | A | 2/1979 | Sooter et al. |
| 4,298,455 | A | 11/1981 | Huang |
| 4,399,024 | A | 8/1983 | Fukui et al. |
| 4,411,770 | A | 10/1983 | Chen et al. |
| 4,430,197 | A | 2/1984 | Poynor et al. |
| 4,440,625 | A | 4/1984 | Go et al. |
| 4,455,219 | A | 6/1984 | Janssen et al. |
| 4,518,487 | A | 5/1985 | Graf et al. |
| 4,529,501 | A | 7/1985 | George |
| 4,549,934 | A | 10/1985 | Graf et al. |
| 4,592,830 | A | 6/1986 | Howell et al. |
| 4,612,109 | A | 9/1986 | Dillon et al. |
| 4,616,308 | A | 10/1986 | Morshedi et al. |
| 4,659,453 | A | 4/1987 | Kukes et al. |
| 4,927,561 | A | 5/1990 | Forester |
| 5,160,602 | A | 11/1992 | Becraft et al. |
| 5,248,410 | A | 9/1993 | Clausen et al. |
| 5,258,115 | A | 11/1993 | Heck et al. |
| 5,460,714 | A | 10/1995 | Fixari et al. |
| 5,645,711 | A | 7/1997 | Hraban et al. |
| 5,820,750 | A | 10/1998 | Blum et al. |
| 5,853,565 | A | 12/1998 | Cayton |
| 6,048,904 | A | 4/2000 | Wiehe et al. |
| 6,168,709 | B1 | 1/2001 | Etter |
| 6,193,875 | B1 | 2/2001 | Pereira et al. |
| 6,204,421 | B1 | 3/2001 | Genssler et al. |
| 6,264,829 | B1 | 7/2001 | Antalffy et al. |
| 6,387,840 | B1 | 5/2002 | Salazar et al. |
| 6,611,735 | B1 | 8/2003 | Henly et al. |
| 6,660,131 | B2 | 12/2003 | Lah |
| 7,303,664 | B2 | 12/2007 | Siskin et al. |
| 7,306,713 | B2 | 12/2007 | Siskin et al. |
| 2002/0033265 | A1 | 3/2002 | Varadaraj |
| 2002/0125174 | A1 | 9/2002 | Varadaraj |
| 2002/0161059 | A1 | 10/2002 | Varadaraj et al. |
| 2003/0127314 | A1 | 7/2003 | Bell et al. |
| 2003/0132139 | A1 | 7/2003 | Varadaraj |
| 2003/0191194 | A1 | 10/2003 | Varadaraj |
| 2004/0035749 | A1 | 2/2004 | Khan et al. |
| 2005/0258070 | A1* | 11/2005 | Varadaraj et al. ..... 208/48 AA |
| 2005/0258071 | A1 | 11/2005 | Varadaraj |
| 2005/0258075 | A1 | 11/2005 | Varadaraj |
| 2005/0263438 | A1 | 12/2005 | Varadaraj et al. |
| 2005/0263440 | A1 | 12/2005 | Varadaraj et al. |
| 2005/0269247 | A1 | 12/2005 | Sparks et al. |
| 2005/0279672 | A1 | 12/2005 | Varadaraj et al. |
| 2005/0279673 | A1 | 12/2005 | Eppig et al. |
| 2005/0284798 | A1 | 12/2005 | Eppig et al. |
| 2006/0006101 | A1 | 1/2006 | Eppig et al. |
| 2006/0021907 | A1 | 2/2006 | Varadaraj et al. |
| 2006/0060506 | A1* | 3/2006 | Siskin et al. ..... 208/131 |
| 2006/0183950 | A1 | 8/2006 | Varadaraj et al. |
| 2006/0196811 | A1 | 9/2006 | Eppig et al. |
| 2007/0108036 | A1 | 5/2007 | Siskin et al. |
| 2009/0314689 | A1 | 12/2009 | Varadaraj et al. |

FOREIGN PATENT DOCUMENTS

| | | |
|---|---|---|
| EP | 0031697 | 8/1981 |
| EP | 0175511 | 1/1988 |
| GB | 1218117 | 1/1971 |
| WO | WO9514069 | 5/1995 |
| WO | WO9964540 | 12/1999 |
| WO | WO03042330 | 5/2003 |
| WO | WO03048271 | 6/2003 |
| WO | WO2004038316 | 5/2004 |
| WO | WO2004104139 | 12/2004 |
| WO | WO2007050350 | 5/2007 |

* cited by examiner

*Primary Examiner*—Glenn A Caldarola
*Assistant Examiner*—Michelle L Stein
(74) *Attorney, Agent, or Firm*—Malcolm D. Keen; Glenn T. Barrett

(57) ABSTRACT

A method for altering coke morphology in a delayed coking process of heavy oil is provided. An effective amount of oil dispersible or oil soluble metal salts of aromatic sulfonic acids and/or polysulfonic acids is added or contacted with the resid or heavy oil at a point before or after the step of heating the heavy oil to coking temperatures. The addition of additives facilitates the formation of shot coke and inhibits the formation of sponge coke.

10 Claims, 3 Drawing Sheets

METHOD TO ALTER COKE MORPHOLOGY USING METAL SALTS OF AROMATIC SULFONIC ACIDS AND/OR POLYSULFONIC ACIDS

1.0 BACKGROUND OF THE INVENTION

1.1 Field of the Invention

The present invention relates to the use of oil dispersible or oil soluble metal salts of aromatic sulfonic acids and/or polysulfonic acids as additives to delayed coking feeds.

1.2 Description of Related Art

Delayed coking is a process for the thermal conversion of heavy oils such as petroleum residua (also referred to as "resid") to produce liquid and vapor hydrocarbon products and coke. Delayed coking of resids from heavy and heavy sour (high sulfur) crude oils is carried out by converting part of the resids to more valuable hydrocarbon products. The resulting coke has value, depending on its grade, as a fuel (fuel grade coke), electrodes for aluminum manufacture (anode grade coke), etc.

In the delayed coking process, the feed is rapidly heated at about 500° C. (932° F.) in a fired heater or tubular furnace. The heated feed is conducted to a coking vessel (also called a "drum") that is maintained at conditions under which coking occurs, generally at temperatures above about 380° C. (716° F.) and super-atmospheric pressures. Coke drums are generally large, upright, cylindrical, metal vessels, typically ninety to one-hundred feet in height, and twenty to thirty feet in diameter. Coke drums have a top portion fitted with a top head and a bottom portion fitted with a bottom head. Coke drums are usually present in pairs so that they can be operated alternately. Coke accumulates in a vessel until it is filled, at which time the heated feed is switched to the alternate empty coke drum. While one coke drum is being filled with heated residual oil, the other vessel is being cooled and purged of coke.

Typically in the cooling step, the filled drum is quenched with water to lower the temperature to a range of about 93° C. to about 148° C. (about 200° F. to about 300° F.), after which the water is drained. When the cooling step is complete, the drum is opened and the coke is removed by drilling and/or cutting. The coke removal step is frequently referred to as "decoking".

In delayed coking, the coke is typically cut from the drum using a high speed, high impact water jet. A hole is typically bored in the coke from water jet nozzles located on a boring tool. Nozzles oriented horizontally on the head of a cutting tool cut the coke from the drum. The coke removal step adds considerably to the throughput time of the process. Drilling and removing coke from the drum takes approximately 1 to 6 hours, and the coker drum is not available for feed coking until the coke removal step is completed. This delay can unfavorably impact the yield of hydrocarbon vapor from the process. Thus, it would be desirable to be able to produce a free-flowing coke in a coker drum, which could be removed more speedily, thereby minimizing the expense and cycle time associated with conventional coke removal.

An additional difficulty that may arise in decoking results from non-uniform coke cooling prior to decoking, a problem sometimes called a "hot drum." Hot drums occur when, following water quench, regions of the coke volume in the drum remain at a significantly higher temperature than other regions. Hot drum may result during cutting or drilling from the presence of different coke morphologies (e.g., shot and needle or shot and sponge) in different regions of the drum. As a result of the different thermal characteristics among the coke morphologies, some coke regions in the drum may differ in temperature significantly from other regions, which can lead to unpredictable and even hazardous conditions during decoking. Since free-flowing coke morphologies cool faster than agglomerated coke morphologies, it would also be desirable to produce predominantly free-flowing coke in a delayed coker in order to avoid or minimize hot drums.

2.0 BRIEF DESCRIPTION OF THE DRAWINGS

The following figures are for illustrative purposes only and are not intended to limit the scope of the present invention in any way:

3.0 SUMMARY OF THE INVENTION

Figure 1:
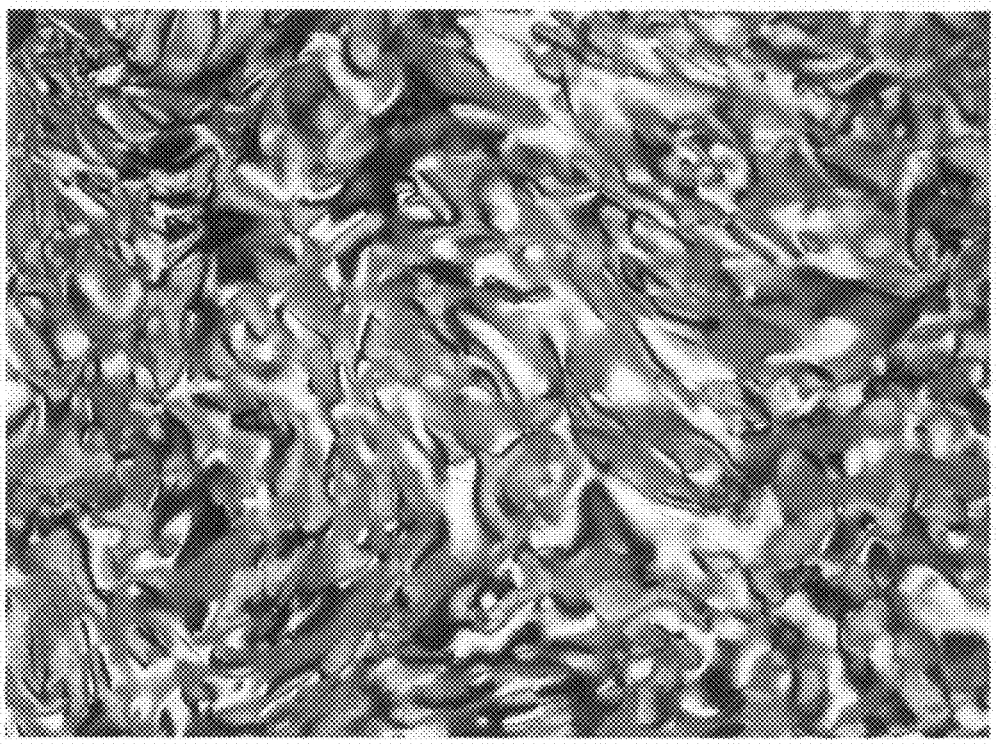
FIG. 1 is an optical micrograph, with a viewing area of 174 microns by 130 microns, showing a comparative example of coke formed from a sponge coke-forming resid feed that contains no additive.

In one embodiment, a method for altering the coke morphology in a delayed coking process of a heavy oil, such as a resid, is provided comprising:

a) contacting the heavy oil with an oil dispersible or oil soluble additive to provide an additized heavy oil, which additive is represented by the chemical structure—

$$Ar—(SO_3^-M^+)_n$$

where Ar is a polycyclic aromatic group having at least two fused rings, M is selected from the alkali and alkaline-earth metals and n is an integer from 1 to 5 when an alkali metal is used and from 2 to 10 when an alkaline earth metal is used; and b) thermally treating the additized heavy oil at a coking temperature in a coking zone (e.g., coke drum).

In a preferred embodiment, Ar comprises 2 to 15 aromatic rings. At least two, and preferably all, of the aromatic rings in Ar are part of a fused ring structure.

The additive is added in an amount effective to increase the formation of substantially free flowing coke during thermal coking operations. The preferred coke morphology (i.e., a typical morphology that is indicative of a substantially free-flowing shot coke) is a coke microstructure of discrete microdomains having an average size ranging from about 0.5 to 10 μm, preferably from about 1 to 5 μm.

4.0 DETAILED DESCRIPTION

4.1 Overview

According to one embodiment of the invention, there is provided a method for altering the coke morphology produced in delayed coking processes of heavy oil. Non-limiting examples of heavy oils include crude oil, vacuum resid, atmospheric resids, tar sands bitumen, coal liquids, shale oils and their heavy fractions. An effective amount of oil dispersible or oil soluble metal salts of aromatic sulfonic acids and/or polysulfonic acids is added or contacted with the heavy oil feed at a point before or during the step of thermally treating the feed at coking temperatures (i.e., at operating temperatures ranging from about 380° C. to about 500° C. in the coking zone). The addition of the aromatic sulfonic acid metal salts and/or aromatic polysulfonic acid metal salts (referred to herein as "additive") enhances or facilitates the formation of shot coke and inhibits the formation of sponge coke.

The additive can be added at one or more points in the coking process. The additive may be added before preheating or after preheating. The additive may be added, for example, while the preheated feed is being conducted to the coker drum and/or while the preheated feed is injected into the coking zone and/or during heating to the coking temperature. The same additive or additives can be added independently at each location or a different additive or additives can be added at each location.

4.2 Additives

Preferred additives include aromatic sulfonic and polysulfonic acid salts of the chemical structure:

$$Ar—(SO_3^-M^+)_n$$

where Ar is a polycyclic aromatic group comprising at least 2 fused rings, M is selected from Group I (alkali) and Group II (alkaline-earth) elements of the periodic table of elements and n is an integer from 1 to 5 when an alkali metal is used and from 2 to 10 when an alkaline earth metal is used. Preferably M is selected from the alkali metals and, more preferably, from sodium, potassium and mixtures thereof. It is preferred that Ar be an polycyclic aromatic group having from 2 to 15 rings, more preferably from 2 to 6 rings and most preferably from 2 to 4 rings. Although it is preferred that Ar be an aromatic group, heterocyclic aromatic groups can also be employed. At least two, and preferably all, of the aromatic rings in Ar are part of a fused ring structure.

The additives of the present invention can be prepared by various methods known in the art. One method for the preparation of the aromatic (poly) sulfonic acid salts is from the sulfonation or polysulfonation of light catalytic cycle oil. Light catalytic cycle oil, alternatively referred to as light cat cycle oil (LCCO), is a complex combination of hydrocarbons produced by the distillation of products from the fluidized catalytic cracking (FCC) process with carbon numbers in the range of about $C_9$ to about $C_{25}$, boiling in the approximate range of 340° F. (171° C.) to 700° F. (371° C.). LCCO is generally rich in 2-ring aromatic molecules. LCCO from a US refinery typically comprises about 80% aromatics. The aromatics are typically 33% 1-ring aromatics and 66% 2-ring aromatics. Further, the 1- and 2-ring aromatics can be methyl, ethyl and propyl substituted. The methyl group is the major substituent. Nitrogen and sulfur containing heterocycles, such as indoles and benzothiophenes are also present in minor quantities and will also be sulfonated to some extent.

Non-limiting examples of thermally stable oil dispersible sulfonic and polysulfonic aromatic acid salts of the present invention are shown below.

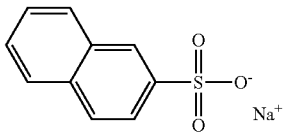

naphthalene-2-sulfonic acid sodium salt

-continued

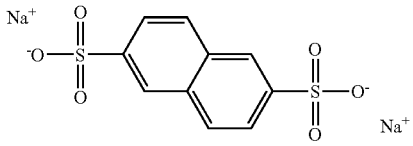

naphthalene-2,6-disulfonic acid sodium salt

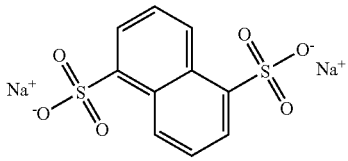

naphthalene-1,5-disulfonic acid sodium salt

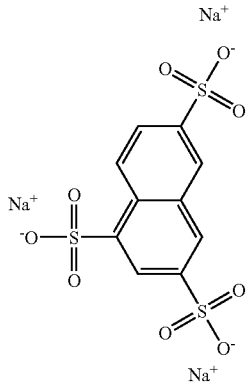

naphthalene-1,3,6-trisulfonic acid sodium salt

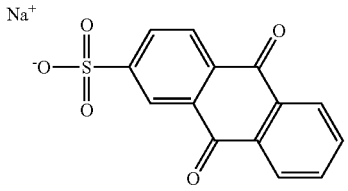

anthraquinone-2-sulfonic acid sodium salt

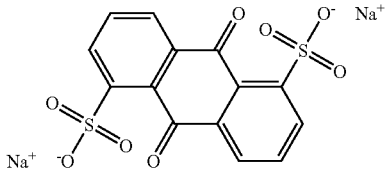

anthraquinone-1,5-disulfonic acid sodium salt

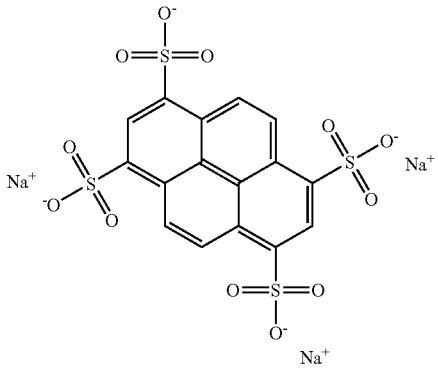

pyrene-1,3,6,8-tetra sulfonic acid sodium salt

One method for producing the sulfonic acid compositions is from LCCO by a process that generally includes the polysulfonation of the LCCO with a stoichiometric excess of sulfuric acid, oleum or sulfur trioxide at effective conditions. Conventional sulfonation of petroleum feedstocks typically uses an excess of the petroleum feedstock—not an excess of sulfuric acid. Unexpectedly however, when a stoichiometric excess of sulfuric acid is used to sulfonate an LCCO, the resulting polysulfonated product has novel properties and uses. The aromatic polysulfonic acid is converted to the aromatic polysulfonic acid salt by treatment with an amount of caustic to neutralize the acid functionality. Examples of caustic include: sodium hydroxide, potassium hydroxide, sodium carbonate, potassium carbonate, sodium cresylates, sodium acetate, potassium naphthenate and the like and mixtures thereof. The LCCO polysulfonic acid composition can best be described as a mixture of 1- and 2-ring aromatic cores with 1 or more sulfonic acid groups per aromatic core. The aromatic cores are methyl, ethyl and propyl substituted, with the methyl group being the more preferred substituent. Other refinery feed stocks (e.g., catalytic slurry oils, heavy aromatic fuel oils and the like) will yield a mixture of two to five ring polysulfonic acids that can be converted to their corresponding metal salts. Feeds with two to six ring aromatics are preferred.

The aromatic sulfonic and polysulfonic acid sodium salts are thermally stable to temperatures up to 600° C. (determined by thermogravimetric analyses (TGA)). FTIR analyses of one of the additives (2,6-naphthalene sulfonic acid disodium salt) before and after TGA confirmed that except for the loss of water, no change occurs upon heating. Thermal stability of the additives, however, is not required for shot coke formation.

While the sodium salt is preferable, other Group I elements of the Periodic Table of elements such as potassium can also be used as the counter ion. Sodium salts of sulfonated light catalytic cycle oil were synthesized and shown to be especially effective.

Typically, the amount of additive added ranges from about 10 to about 50,000 wppm, preferably from about 50 to about 3000 wppm, and more preferably from about 50 to about 600 wppm, based on the amount of crude oil or crude oil residuum. Sodium and potassium salts of the additives are largely water-soluble and hence can be easily introduced into oil as a water-in-oil emulsion. Upon heating the water-in-oil emulsion to 100° C., water is evaporated off, resulting in a dispersion of the additive in oil.

The additive can be added as is. Alternatively, the additive can be added in a suitable carrier solvent which is preferably water or a water-alcohol mixture. Preferred alcohols are methanol, ethanol, propanol and mixtures thereof. The carrier solvent is preferably 10 to 80 weight percent of the mixture of additive and carrier solvent. The additives are also soluble in aromatic solvents like benzene, toluene, and xylenes and can be first dissolved in one or more of such types of solvent and added as a solution.

4.3 Delayed Coking

Heavy oils such as resid feeds are typically subjected to delayed coking. Generally, in delayed coking, a residue fraction, such as a petroleum residuum feedstock is pumped to a heater at a pressure of about 50 to 550 psig (344.74 to 3792.12 kPa), where it is heated to a temperature from about 480° C. to about 520° C. (preferably greater than 500° C.). It is then discharged into a coking zone, typically a vertically-oriented, insulated coker drum through an inlet at the base of the drum. Pressure in the drum is usually relatively low, such as about 15 to 80 psig (103.42 to 551.58 kPa) to allow volatiles to be removed overhead. Typical operating temperatures of the drum will be between about 410° C. and 475° C. The hot feedstock thermally cracks over a period of time (i.e., the "coking time") in the coker drum, liberating volatiles composed primarily of hydrocarbon products that continuously rise through the coke mass (bed) and are collected overhead. The volatile products are sent to a coker fractionator for distillation and recovery of coker gases, naphtha, light gas oil and heavy gas oil fractions. In some instances, a small portion of the heavy coker gas oil present in the product stream introduced into the coker fractionator can be captured for recycle and combined with the fresh feed, thereby forming the coker heater or coker furnace charge. In addition to the volatile products, delayed coking also forms solid coke product.

4.4 Introduction of Additives into the Heavy Oil

Introducing or contacting the additive with the heavy oil can be achieved at any time before or after the pre-heating of the heavy oil, and preferably when the pre-heated heavy oil is conducted, discharged or otherwise transferred from the furnace or heater to the coking zone or coker vessel (alternatively referred to as a coker or coker drum). In particular, the additive can be added at one or more of the following points: prior to pre-heating the feed; after preheating but before the preheated feed is conducted to the coker drum; while the feed is being conducted to the coker drum and/or injected into the coker; and during coking (i.e., thermal treatment at a coking temperature). The same additives can be added independently at each location or a different additive or additives can be added at each location.

Use of the terms "add", "combine" and "contact" are meant in their broad sense. In some cases physical and/or chemical changes in the additive and/or the feed can occur in the additive, the feed, or both, when the additive is present in the feed. In other words, the invention is not restricted to cases where the additive and/or feed undergo no chemical and/or physical change following, or in the course of, the contacting and/or combining.

An "effective amount" of additive(s) is the amount of additive(s) that, when contacted with the feed, results in increased formation of free-flowing coke in the coking zone. An effective amount typically ranges from about 10 to about 5,000 ppm based on the total weight of the metal in the additive to the weight of the feed. Ideally, a substantially uniform free-flowing coke is formed throughout the coking zone. The preferred coke morphology (i.e., a typical morphology that is indicative of a substantially free-flowing shot coke) is a coke microstructure of discrete micro-domains having an average size of about 0.5 to 10 μm, preferably from about 1 to 5 μm.

Uniform dispersal of the additive into the resid feed is desirable to avoid heterogeneous areas of coke morphology formation. That is, it is preferred to avoid having locations in the coke drum where the coke is substantially free flowing and other areas where the coke is substantially non-free flowing. Uniform dispersal of the additive is one way to avoid heterogeneous areas of coke morphology formation and can be accomplished in any number of ways. Preferably, uniform dispersal is accomplished by introducing a side stream of the agent into the feed stream at the desired location.

In one embodiment, additives(s) are introduced to the heavy oil in a continuous mode. If needed, the additive(s) could be dissolved or slurried into an appropriate transfer fluid, which will typically be solvent that is compatible with the resid and in which the agent is substantially soluble. The fluid mixture or slurry is then pumped into the coking process at a rate to achieve the desired concentration of additive(s) in the feed. The introduction point of the additive(s) can be, for example, at the discharge of the furnace feed charge pumps or near the exit of the coker transfer line. There can be a pair of mixing vessels operated in a fashion such that there is continuous introduction of the additive(s) into the coking process.

4.5 Coke Products

There are generally three different types of solid delayed coker products that have different values, appearances and properties—namely, needle coke, sponge coke and shot coke. Needle coke is the highest quality of the three varieties. Needle coke, upon further thermal treatment, has high electrical conductivity (and a low coefficient of thermal expansion) and is used in electric arc steel production. It is relatively low in sulfur and metals and is frequently produced from some of the higher quality coker feedstocks that include more aromatic feedstocks such as slurry and decant oils from catalytic crackers and thermal cracking tars. Typically, it is not formed by delayed coking of resid feeds.

Sponge coke, a lower quality coke, is most often formed in refineries. Low quality refinery coker feedstocks having significant amounts of asphaltenes, heteroatoms and metals produce this lower quality coke. If the sulfur and metals content is low enough, sponge coke can be used for the manufacture of electrodes for the aluminum industry. If the sulfur and metals content is too high, then the coke can be used as fuel. The name "sponge coke" comes from its porous, sponge-like appearance. Conventional delayed coking processes, using the preferred vacuum resid feedstock of the present invention, will typically produce sponge coke, which is produced as an agglomerated mass that needs an extensive removal process including drilling and water-jet technology. As discussed, this considerably complicates the process by increasing the cycle time.

Shot coke is considered the lowest quality coke. The term "shot coke" comes from its shape, which is similar to that of BB-sized (about 1/16 inch to 3/8 inch) balls. Shot coke, like the other types of coke, has a tendency to agglomerate, especially in admixture with sponge coke, into larger masses, sometimes larger than a foot in diameter. This can cause refinery equipment and processing problems. Shot coke is usually made from the lowest quality high resin-asphaltene feeds and makes a good high sulfur fuel source, particularly for use in cement kilns and steel manufacture.

The addition of the oil dispersible or oil soluble aromatic (poly)sulfonic acid metal salts to heavy oil aids the formation of a more free flowing coke and, more particularly, a free flowing shot coke. The formation of such free flowing coke reduces or minimizes the amount of drilling necessary to empty the drum and prepare it for the next cycle. More particularly, by aiding in the formation of free flowing shot coke, the amount of coke required to be cut from the drum, and the time required for cutting/polishing a drum can be markedly reduced because the bulk of the loose coke formed will be discharged from the drum without having to be cut. Ideally, the cutting step is completely eliminated. However, even if some cutting is still required to adequately clean the drum for the next cycle in some instances, cutting time is still reduced because less coke remains in the drum to be removed.

4.6 Examples

The following examples are included herein for illustrative purposes and are not meant to be limiting.

4.6.1 Example 1

A Micro Concarbon Residue (MCR) test was conducted on a vacuum resid alone, the same vacuum resid treated with the 2,6-naphthalene disulfonic acid sodium salt (NDSS) and the same vacuum resid treated with 1,3,6-napthalene trisulfonic acid sodium salt (NTSS). As observed in Table 1 below, the addition of 3000 wppm of the naphthalene sulfonic acid sodium salts lowered the micro Concarbon residue, indicative of a potential to inhibit mesophase formation and thereby facilitate the formation of shot coke.

TABLE 1

| MCR (wt %) | |
|---|---|
| Heavy Canadian Vacuum Resid (HCVR) | 22.86 |
| HCVR + 3000 wppm 2,6-NDSS | 21.57 |
| HCVR + 3000 wppm 1,3,6-NTSS | 20.77 |

4.6.2 Examples 2 and 3

Example 2 and 3 use the same resid feed—namely, Baton Rouge Refinery VTB which is a sponge coke-forming resid. In Example 2, 1,000 wppm (weight parts per million) of naphthalene-1-sulfonic acid sodium salt was added. In Example 3, 1,000 wppm of naphthalene-2,6-disulfonic acid sodium salt was added.

The addition of additives into the vacuum resid feeds in Examples 2 and 3 was performed in the following manner. First, the resid feed was heated to about 70-150° C. to decrease its viscosity. Then the additive was added slowly, with mixing, for a time sufficient to disperse and/or solubilize the additive.

For laboratory experiments, it is generally preferred to first dissolve and/or disperse the additive in a solvent (e.g., toluene, or water) and blend it with stirring into the heated resid, or into resid to which some solvent has been added to reduce its viscosity. Alternatively, the additive can be dissolved in a solvent and a solvent can be added to the resid to decrease its viscosity. Blending of the dissolved additive and lower viscosity resid solution can take place even at room temperature. The solvent(s) can then be removed. In a refinery, the additive or additive dissolved in resid contacts the resid when it is added to, or combined with, the resid feed. As discussed, the contacting of the additive and the feed can be accomplished by blending a feed fraction containing additive species (including feed fractions that contain such species) into the feed. Additives in the form of organic salts are generally soluble in the resids. To assure maximum dispersion of the additive into the resid feed, the reaction mixture may be heat soaked.

4.6.3 Comparative Example

A comparative example was prepared in the same manner and using the same resid feed as examples 2 and 3 (i.e., Baton Rouge Refiner VTB) but with no additive.

4.6.4 Microcarbon Residue (MCR) Tests

The standard Micro Concarbon Residue (MCR) test shows the effectiveness of the additives in examples 2 and 3 in enhancing or facilitating the formation of shot coke in delayed coking compared to the comparative example. MCR tests were run for examples 2, 3 and the comparative example. The MCR tests were performed according to the following procedure. A sample of vacuum residuum (~2 g) is heated from room temperature to 100° C. over 10 minutes under a nitrogen flow of 66 cc/min. The temperature is then increased from 100-300° C. at the 66 mL/min flow rate and from 300-500° C. at a reduced nitrogen flow rate of 19.5 cc/min over 30 min. The sample is then held at 500° C. for 15 min at 19.5 mL/min flow rate of nitrogen and finally cooled to room temperature over 40 minutes while maintaining the 19.5 mL/min nitrogen flow rate. The coke produced from the resid is weighed and expressed as a weight percent based on the weight of the starting sample. The MCR cokes of examples 2, 3 and the comparative example were 16.5, 15.5 and 20.5 wt %, respectively.

4.6.5 Polarized Light Optical Microscopy

Polarized Light Optical Microscopy is the preferred method for identifying and characterizing the morphology of thermal coke. The key indicator is the optical texture of the polished cross-section of the sample. In most cases, thermal coke consists of small regions of anisotroptic (ordered) carbon called mosaics (ranging in size from less than a micron to 10 microns) and larger regions called domains (greater than 10 microns). The larger the mosaic or domain size, the greater the degree of order in the coke. The observed anisotropic structure in thermal coke is made possible by a liquid crystal precursor called mesophase, which begins to form from the liquid phase above 400° C. The greater the opportunity for the mesophase to grow and coalesce in the liquid phase, the greater the degree of order in the thermal coke. Factors affecting mesophase growth include the properties of the pitch, the coking temperature and the time spent at temperature. Therefore, the observed anisotropic texture of a thermal coke reveals qualitative information on the conditions in which the coke was formed. Isotropic coke, in contrast, is usually formed by decomposition of polymeric material or other highly cross-linked structure that has not gone through the intermediate fluid phase.

Optical microscope samples were prepared using techniques known in the art. Examples 2, 3 and the comparative example were prepared by embedding the coke sample in epoxy, followed by a series of standard grinding and polishing procedures. The highly polished cross-section of each sample is then examined under reflected cross-polarized light. In order to add color to the image, a λ retardation plate (full wave) is inserted between the cross polars. The resulting pink, blue and yellow regions of the sample (mosaics and domains) are caused by different orientations of the anisotropic material with respect to the polarized light. Observations of examples 2 and 3 and the comparative example were made with a 20× or 50× oil immersion objective in order to enhance contrast. Observations made on the samples include general morphology, particle size, degree of anisotropy, reflectance, porosity and inclusions (such as metal sulfides).

FIG. 1 is an optical micrograph of the comparative example. The micrograph of FIG. 1 shows coke formed from the sponge coke-forming resid feed (Baton Rouge Refinery VTB) with no additive. The viewing area shown is 174 microns by 130 microns. The micrograph shows flow domains ranging in size from about 10 to about 30 micrometers (typical of sponge coke) and minor regions of coarse mosaic ranging from about 5 to about 10 micrometers (typical of shot coke).

Figure 2:
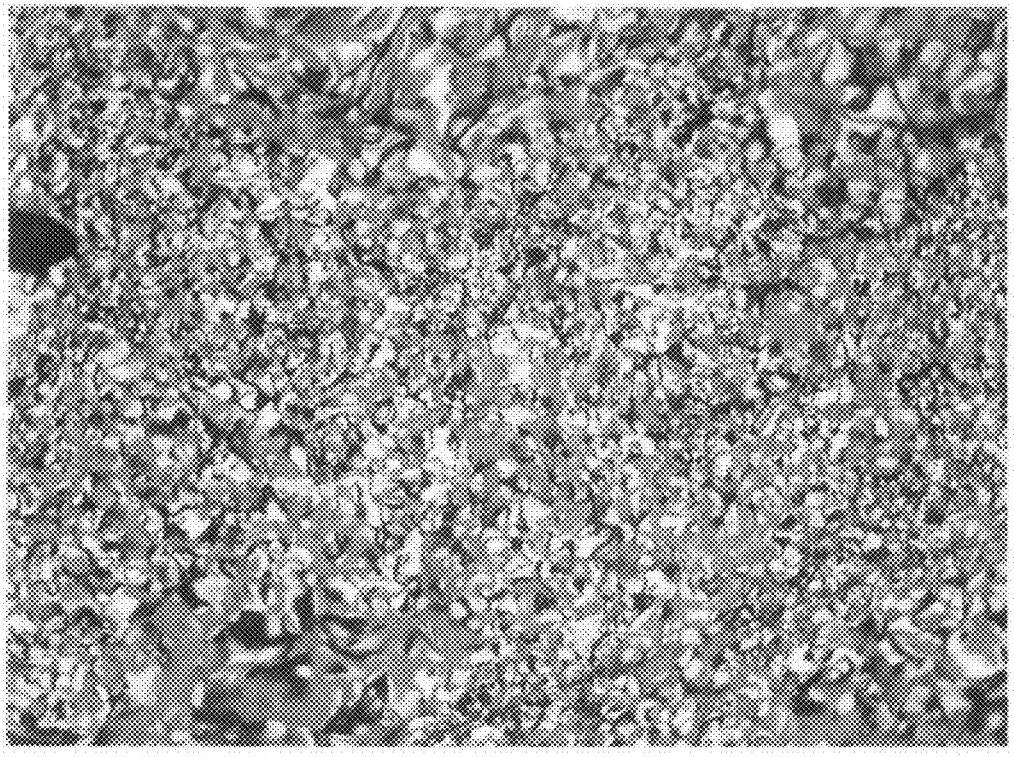
FIG. 2 is an optical micrograph, with a viewing area of 174 microns by 130 microns, showing an inventive example of coke formed from the sponge coke-forming resid feed of FIG. 1 to which 1,000 wppm of naphthalene-1-sulfonic acid sodium salt was added.

FIG. 2 shows the effect on coke morphology of adding 1,000 wppm of naphthalene-1-sulfonic acid sodium salt to the sponge coke-forming resid prior to coking. FIG. 2 is an optical micrograph showing coke formed from the same resid feed of FIG. 1 to which 1,000 wppm of naphthalene-1-sulfonic acid sodium salt was added. Again, the viewing area shown is 174 microns by 130 microns. FIG. 2 shows a fine/medium mosaic in the range of about 1 to about 5 micrometers (typical of shot coke) and minor regions of coarse mosaic of about 5 to about 10 micrometers (somewhat indicative of sponge coke).

Figure 3:
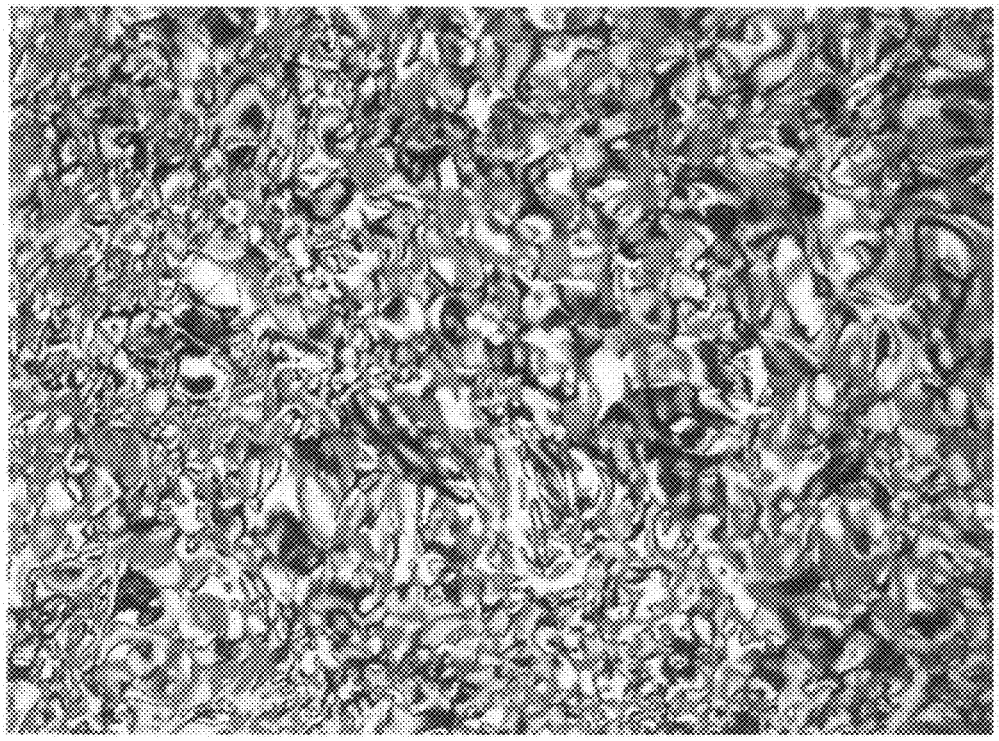
FIG. 3 is an optical micrograph, with a viewing area of 174 microns by 130 microns, showing an inventive example of coke formed from the sponge coke-forming resid feed of FIG. 1 to which 1,000 wppm of 2,6-naphthalene disulfonic acid sodium salt was added.

FIG. 3 shows the effect on coke morphology of adding 1,000 wppm of naphthalene-2,6-disulfonic acid sodium salt to the resid prior to coking. FIG. 3 is an optical micrograph showing coke formed from the sponge coke forming resid feed of FIG. 1 to which 1,000 wppm of 2,6-naphthalene disulfonic acid sodium salt was added. Again, the viewing area shown is 174 microns by 130 microns. FIG. 3 shows a medium/coarse mosaic in the range of about 2 to about 10 micrometers (typical of shot coke) and minor regions of small domains of about 10 to about 12 micrometers (indicative of sponge coke).

A comparison of the micrographs of both FIG. 2 and FIG. 3 to FIG. 1 illustrates the significant effect of the additives on coke morphology. The addition of the additives drives the coke morphology to the formation of shot coke.

4.7 Alternatives

There will be various modifications, adjustments, and applications of the disclosed invention that will be apparent to those of skill in the art, and the present application is intended to cover such embodiments. Accordingly, while the present invention has been described in the context of certain preferred embodiments, it is intended that the full scope of the invention be measured by reference to the scope of the following claims.

What is claimed is:

1. A method for altering the coke morphology in a delayed coking process of heavy oil in which the heavy oil is heated in a furnace and then passed to a delayed coking drum in which it is coked, the method comprising:

a) contacting the heavy oil after the heating in the furnace and during the transition of the heavy oil from the furnace to the coking drum, with an oil dispersible or oil soluble additive to provide an additized heavy oil, which additive is represented by the chemical structure $$Ar—(SO_3^-M^+)_n$$

where AR is a polycyclic aromatic group having at least 2 fused rings, M is selected from the alkali and alkaline-earth metals and n is an integer from 1 to 5 when an alkali metal is used and from 2-10 when an alkaline earth metal is used, where the additive is added in an amount from 10 to 50,000 wppm based on the weight of the heavy oil and effective to increase the formation of substantially free-flowing coke during coking operations; and b) coking said additized heavy oil in the delayed coking drum at a coking temperature from 380° C. to 480° C. in the coking drum to produce a coke product the majority of which is free-flowing; and c) discharging free-flowing coke from the drum without cutting.

2. The method of claim 1 wherein the heavy oil is a vacuum resid.

3. The method of claim 1 wherein M is an alkali metal chosen from the group consisting of sodium, potassium and mixtures thereof.

4. The method of claim 1 where Ar is a polycyclic aromatic group having 2 to 6 fused ring.

5. The method of claim 3 where Ar is a polycyclic aromatic group having 2 to 6 fused rings.

6. The method of claim 1 wherein n is 1.

7. The method of claim 5 wherein n is 1.

8. The method of claim 1 wherein the additive is selected from the group consisting of naphthalene-2-sulfonic acid sodium salt, naphthalene-2,6-disulfonic acid sodium salt, naphthalene-1,5-disulfonic acid sodium salt, naphthalene-1,3,6-trisulfonic acid sodium salt; anthraquinone-2-sulfonic acid sodium salt, anthraquinone-1,5-disulfonic acid sodium salt, and pyrene-1,3,6,8-tetra sulfonic acid sodium salt.

9. The method of claim 1 wherein the effective amount of additive is from 50 to 3,000 wppm.

10. The method of claim 9 wherein the effective amount of additive is from 50 to 600 wppm.

* * * * *